United States Patent [19]

Lund

[11] Patent Number: 4,516,786

[45] Date of Patent: May 14, 1985

[54] CORE CHUCK

[76] Inventor: Arnold M. Lund, 1210 Avocado Ave., Escondido, Calif. 92026

[21] Appl. No.: 473,240

[22] Filed: Mar. 8, 1983

[51] Int. Cl.[3] ..... B23B 31/40

[52] U.S. Cl. ..... 279/2 R; 242/72 R

[58] Field of Search ..... 279/2 R, 2 A; 242/72, 242/46.4, 72 B, 72.1

[56] References Cited

U.S. PATENT DOCUMENTS

| | | | |
|---|---|---|---|
| 1,918,522 | 7/1933 | Crane | 279/2 X |
| 2,749,133 | 6/1956 | Rich | 279/2 |
| 3,269,128 | 8/1966 | Rusche | 242/72 X |
| 3,355,121 | 6/1967 | Wright | 242/68.2 |
| 3,712,555 | 1/1973 | O'Brien | 279/2 X |
| 3,792,868 | 2/1974 | Flagg | 242/72 R |
| 3,923,268 | 12/1975 | Urynowicz | 242/72 X |
| 3,963,250 | 6/1976 | Flagg | 242/72 R |
| 4,193,633 | 3/1980 | Potter | 279/2 X |
| 4,339,094 | 7/1982 | Thievessen et al. | 242/72 R |

FOREIGN PATENT DOCUMENTS

| | | | |
|---|---|---|---|
| 3109157 | 1/1982 | Fed. Rep. of Germany | 279/2 R |
| 3227040 | 2/1983 | Fed. Rep. of Germany | 242/72 |
| 2809947 | 9/1979 | German Democratic Rep. | 242/72 R |
| 2910114 | 9/1980 | German Democratic Rep. | 242/72 R |
| 537332 | 7/1973 | Switzerland | 242/72 |
| 629726 | 5/1982 | Switzerland | 279/2 R |
| 1390371 | 4/1975 | United Kingdom | 242/72 |
| 2044813 | 10/1980 | United Kingdom | 242/72 |
| 2071535 | 8/1981 | United Kingdom | 279/2 R |
| 2103761 | 2/1983 | United Kingdom | 279/2 R |

OTHER PUBLICATIONS

Mohawk Expanding Chucks (3 pages of advertisement) 7-22-83.

Sonoco Mechanical Core Chuck Model III (2 pages of advertisement) 10/13/66.

The Grabbers Nim-Cor Air Chuck (1 page of advertising) 7-22-83.

*Primary Examiner*—William R. Briggs

*Assistant Examiner*—Glenn L. Webb

*Attorney, Agent, or Firm*—Baker, Maxham, Callan & Jester

[57] ABSTRACT

An expanding mandrel chuck for internally gripping a tubular core. The chuck has a cylindrical sleeve which can be slid over the shaft of a web handling apparatus, core cutter, or other apparatus. A plurality of hexagonal shaped cams surround the intermediate portion of the sleeve. The flat surfaces of these cams are aligned. A plurality of circumferentially spaced, generally pie-shaped jaw segments are freely positioned in overlying relationship with respect to the cams. Each segment has a flat inner surface overlying a corresponding set of faces of the cams. Guide pins extend from opposing end surfaces of each segment and slide within radial slots in disks mounted on the sleeve on opposite sides of the segments. Spring rings are mounted in grooves between the cams and yielding urge the jaw segments radially outwardly. Relative rotation between the cams and the segments causes the cams to push the segments radially outwardly into positive gripping relationship with the inner wall of a surrounding core.

8 Claims, 6 Drawing Figures

CORE CHUCK

BACKGROUND OF THE INVENTION

The present invention relates to apparatus for holding a work piece in a machine, and more particularly, to an expanding mandrel type chuck adapted for internally gripping a tubular core in a web handling apparatus, core cutter or in other applications.

Relatively thin sheet materials such as film, foil, paper, laminate and cloth are typically manufactured in the form of wide, long webs. These webs may measure, for example, six feet in width by one-thousand feet in length. Each web is usually wound about an elongate cylindrical supply core for transport and storage. The manufacture of consumer products from such webs, for example rolls of adhesive tape, usually involves the user of apparatus known as a slitter-rewinder. An example of this type of apparatus is manufactured by Arrow Converting Equipment, Inc., Law Drive, Fairfield, N.J. 07006.

A slitter-rewinder apparatus typically includes an upright frame with means for rotatably supporting the core of the supply roll. The core is typically a tubular piece of cardboard having a diameter of, for example, three inches or six inches. The slitter-rewinder apparatus must have a means of rapidly mounting and removing the supply core. During the slitting and rewinding operation, it is important that there be a positive, non-slip engagement between the supply core and the means for rotatably supporting the same.

There are a number of conventional ways in which the supply core may be mounted on the slitter-rewinder apparatus. Cone shaped mandrels mounted on stub shafts may be forced into opposite ends of the core. Another conventional approach for removably mounting the supply core utilizes a pair of chucks mounted in spaced apart relation on a shaft or shafts. The supply core is slid over the shaft so that the chucks are positioned within opposite ends of the core. In one version, the chucks include a central cylindrical body and spring steel fingers which are tangentially secured to the body. The ends of the fingers push against the inner surfaces of the core to rigidly hold the core in position relative to the shaft. The spring steel fingers eventually fatigue and must be bent outwardly. Furthermore, the fingers tend to scar the inside surface of the supply core.

Another chuck which is utilized in conjunction with slitter-rewinder apparatus to support the supply core is sold under the trademark MOHAWK by Blackhawk Company, 545—12th Street, Rock Island, Ill., 61201. This chuck has a segmented sleeve which may be expanded against the inner surface of the core utilizing a special tool. Right handed and left handed chucks must be utilized to support a supply core at each end. Depending upon the direction of web feed, it may be necessary to reverse the orientation of the MOHAWK expanding chuck.

Another chuck utilized with slitter-rewinder apparatus is sold under the trademark GRABBERS by Nim-Core, Inc., Nashau, N.H. This core chuck utilizes rubber elements.

Still another chuck utilized with slitter-rewinder apparatus is disclosed in U.S. Pat. No. 3,355,121 and is sold under the trademarks SONOCO and CHAMPION by Western Tool and Manufacturing Company, Inc., 1940 South Yellow Springs Street, Springfield, Ohio, 45506. That chuck includes a stub shaft having an intermediate portion of polygonal cross-sectional shape which underlies floating segments that are yielding urged radially outward into engagement with the cardboard core. The chuck sold under the SONOCO trademark has six spring-loaded steel balls for holding the expanding jaws outward. The present invention is an improvement of the expansible chuck of U.S. Pat. No. 3,355,121.

SUMMARY OF THE INVENTION

Accordingly, it is the primary object of the present invention to provide an improved core chuck.

It is another object of the present invention to provide an improved expanding mandrel chuck.

Still another object of the present invention is to provide an automatic expanding mandrel chuck having an improved internal construction.

Accordingly, the present invention provides an expanding mandrel chuck for internally gripping a tubular core. A cylindrical sleeve which can be slid over the shaft of a slitter-rewinder or similar apparatus has a plurality of hexagonal shaped cams which surround its intermediate portion. The flat surfaces of these cams are aligned. A plurality of circumferentially spaced, generally pie-shaped jaw segments are freely positioned in overlying relationship with respect to the cams. Each segment has a flat inner surface overlying a corresponding set of faces of the cams. Guide pins extend from opposing end surfaces of each segment and slide within radial slots in disks mounted on the sleeve on opposite sides of the segments. Spring rings are mounted in grooves between the cams and yielding urge the jaw segments radially outwardly. Relative rotation between the cams and the segments causes the cams to push the segments radially outwardly into positive gripping relationship with the inner wall of a surrounding core.

DESCRIPTION OF THE PREFERRED EMBODIMENTS

Figure 2:
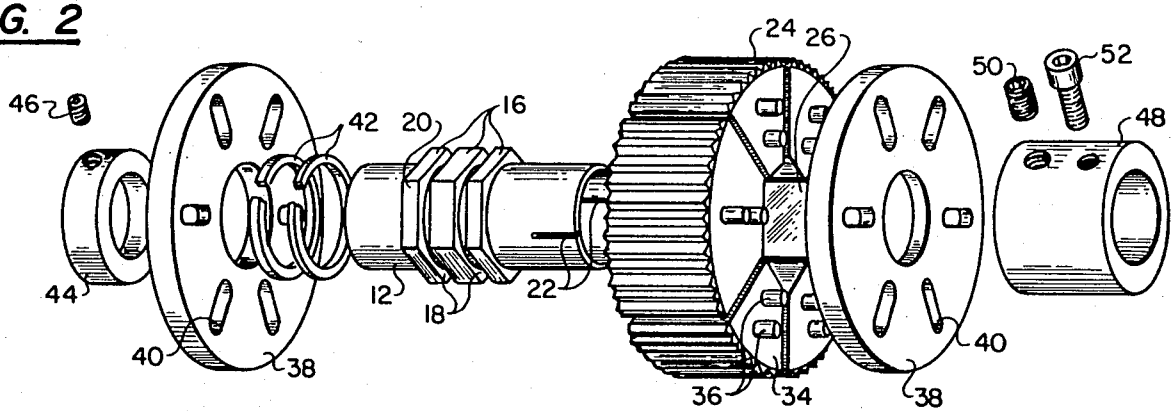
FIG. 2 is an exploded, perspective view of the first embodiment of my core chuck.

Referring to FIGS. 1–4, a first embodiment 10 of my core chuck includes a cylindrical sleeve 12 (FIG. 2) adapted to slide over a shaft 14 (FIG. 1) of a slitter-rewinder or similar apparatus. Cams 16 (FIG. 2) surround the intermediate portion of the sleeve and define annular grooves 18 therebetween. The cams are rigidly attached to the sleeve and have a plurality of flat faces 20. The faces of the cams are aligned, i.e., adjacent faces are in the same plane. In the illustrated embodiment, the cams have a hexagonal shape. One end of the sleeve is formed with a pair of longitudinally extending, diametrically positioned slots 22.

Figure 3:
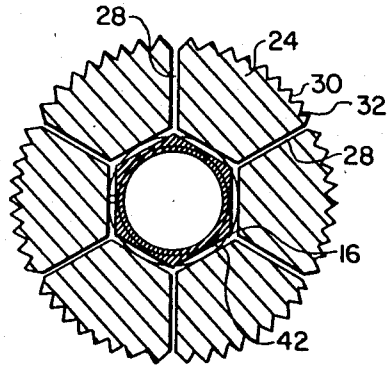
FIG. 3 is a cross-sectional view of the first embodiment of my core chuck taken along line 3—3 of FIG. 1.

A plurality of circumferentially spaced segments 24 (FIGS. 2 and 3) are freely positioned in overlying relationship with the cams 16. Each segment has a flat inner surface 26 (FIG. 2) which overlies a corresponding set of faces 20 of the cams as illustrated in FIG. 3. Each segment further has a pair of outwardly diverging side surfaces 28 (FIG. 3) and an arcuate outer surface 30. The outer surface is formed with a plurality of longitudinally extending splines 32 which grip the inner surface of the core. Alternatively, instead of splines a rubber coated surface or some other gripping surface may be utilized. Each segment further has a pair of opposing end surfaces 34 (FIG. 2) from which a pair of radially spaced guide pins 36 extend perpendicular to the end surface.

Figure 1:
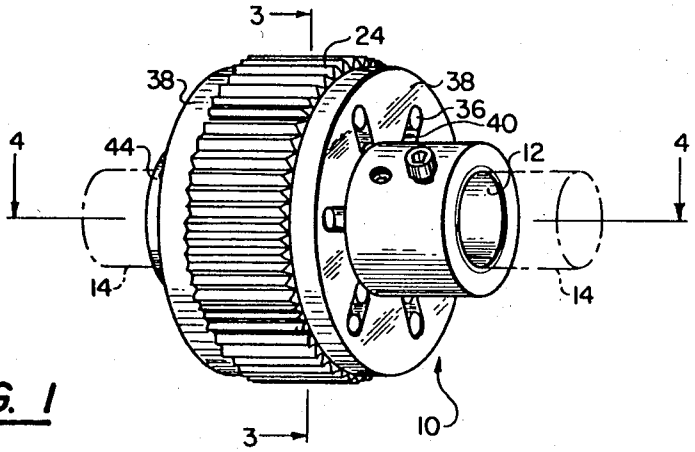
FIG. 1 is an assembled, perspective view of a first embodiment of my improved core chuck.

A pair of disks 38 (FIG. 4) are mounted over opposite ends of the sleeve 12 with the segments 24 positioned therebetween. Each disk has a plurality of circumferentially spaced, radially extending slots 40 (FIG. 2) for receiving the guide pins of the segments as illustrated in FIG. 1. Thus, the guide pins on opposite end surfaces of each segment 24 guide the segment in radial inward and outward movement relative to the central sleeve 12. The lengths of the slots 40 define the range of such radial movement of the segments.

Figure 4:
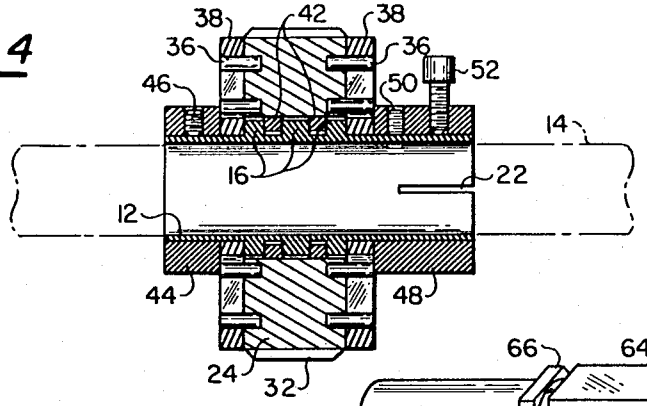
FIG. 4 is a longitudinal sectional view of the first embodiment of my core chuck taken along line 4—4 of FIG. 1.

A pair of spring rings 42 (FIG. 2) are seated in corresponding ones of the annular grooves 18 between the cams (see FIG. 4). These spring rings yieldingly urge the segments radially outwardly into uniformly spaced relationship relative to the sleeve as illustrated in FIG. 3. A first collar 44 (FIG. 2) having a set screw 46 fits over one end of the sleeve 12 to hold one of the disks 38 in position. A second collar 48 fits over the slotted end of the sleeve to hold the other disk 38 in position. The second collar has an inner set screw 50 which holds the collar in position on the sleeve. An outer set screw 52 is positioned for engaging a portion of the sleeve between the slots 22. The set screw 52 forces this portion of the sleeve against the shaft 14 to hold the chuck in position on the shaft. This arrangement prevents the usual scarring of the shaft which would otherwise occur if the set screw directly engaged the shaft.

In operation, a pair of core chucks of the type illustrated in FIGS. 1–4 are slid over the shaft 14 of a slitter-rewinder of similar apparatus. The set screws 52 of these core chucks are tightened to lock the chucks in longitudinally spaced relationship on the shaft 14 so that the chucks will be positioned within opposite ends of the core of a supply roll slid over the same. The chucks are dimensioned so that their segments 24 must be slightly moved radially inwardly in order for the cardboard core to slide thereover. The spring rings 42 thereafter gently urge the splined outer surfaces of the segments against the inner wall of the cardboard core.

During operation of the slitter-rewinder apparatus, the paper or other web material is pulled from the supply roll and a restraining force is applied to the shaft 14 in the opposite direction to achieve a predetermined tension on the unwinding web. The segments 24 which are engaged with the inner wall of the cardboard core, rotate with the core. Thus, there is a relative rotational movement between the segments 24 and the cams 16. Due to the dimensioning of the slots 40 in the disks and the size of the spring rings 42, such relative rotational movement causes the apexes defined by the intersection of adjacent cams faces 20 to engage the flat inner surfaces 26 of the segments 24. The segments are thus forced radially outwardly. This presses the segments against the core to insure a positive locking grip between the chuck and the core.

Figure 6:
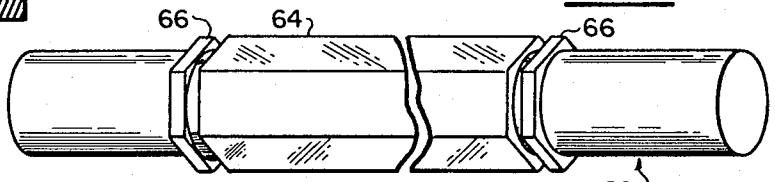
FIG. 6 is a fragmentary, perspective view of the central shaft of the second embodiment of my core chuck.
Figure 5:
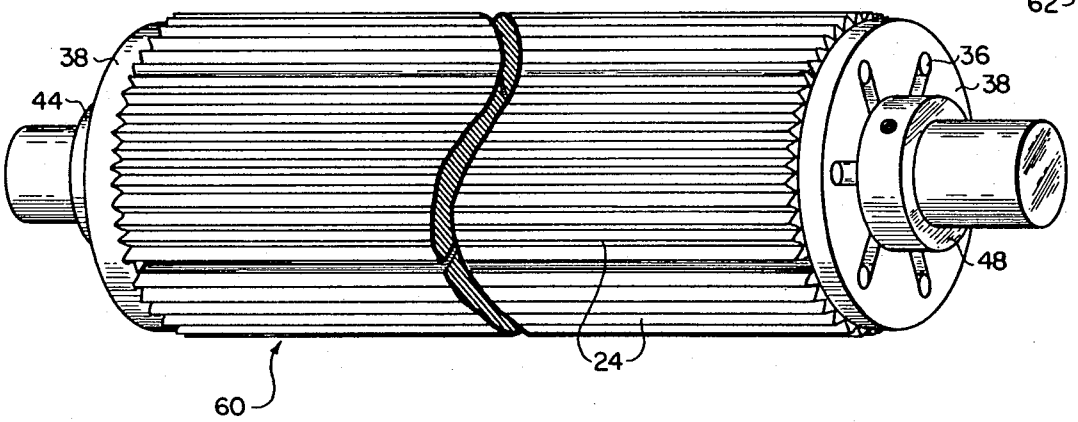
FIG. 5 is a fragmentary, perspective view of a second embodiment of my core chuck.

FIGS. 5 and 6 illustrate a second embodiment 60 of my core chuck which extends substantially the entire length of the core instead of using two individual chucks of the type illustrated in FIGS. 1–4. The second embodiment of my core chuck is similar in construction to the first embodiment, except that the second embodiment utilizes a long shaft 62 (FIG. 6). The shaft has an intermediate, hexagonal cam 64 which extends a major portion of the length of the shaft. Hexagonal end cams 66 are spaced from each end of the cam 64 and spring rings (not illustrated in FIGS. 5 and 6) are seated in the grooves defined between the cams 64 and 66. The segments 24' (FIG. 5) extend a major portion of the length of the shaft 62 and operate in the same fashion as the segments 24 of the first embodiment.

My core chuck can be used to mount work pieces other than cardboard cores, such as pipe, tubing, etc. It will securely hold such a work piece to a shaft without slippage. The grabbing tension increases as relative torque between the shaft and supply roll increases. This occurs automatically, in both directions. When the core is to be removed from the chuck, it can be turned or rocked slightly in a direction opposite of that in which the web was pulled. This will release the tension, and the core can be pulled off easily.

Having described preferred embodiments of my improved core chuck, it should be understood that modification and adaptations thereof will occur to those skilled in the art. Accordingly, the protection afforded my invention should be limited only in accordance with the scope of the following claims.

I claim:

1. A chuck for a tubular core, comprising:

a cylindrical sleeve;

a plurality of spaced apart cams surrounding the intermediate portion of the sleeve and having a plurality of flat aligned faces;

a like plurality of circumferentially spaced segments freely positioned in overlying relationship with the cams, each segment having a flat inner surface overlying a corresponding set of aligned faces of the cams, outwardly diverging side surfaces, an arcuate outer surface, a pair of opposing end surfaces, and guide pins extending perpendicular from the end surfaces;

a pair of disks mounted on opposite ends of the sleeve with the segments positioned therebetween, each disk having a plurality of circumferentially spaced, radially extending slots for receiving the guide pins of the segments to limit radial movement of the segments;

a plurality of spring rings surrounding the sleeve and positioned between adjacent ones of the cams for yieldingly urging the segments radially outwardly into uniformly spaced relationship relative to the sleeve; and means for locking the position of the sleeve relative to a shaft inserted through the sleeve;

the slots and springs being dimensioned so that when the cams rotate relative to the segments, the cams engage the inner surfaces of the segments and move the segments radially outwardly.

2. A chuck according to claim 1 and further comprising collar means for surrounding the opposite ends of the sleeve to hold the disks in position.

3. A chuck according to claim 1 wherein there are six segments and the cams have a hexagonal shape.

4. A chuck according to claim 1 wherein the sleeve has a plurality of longitudinally extending slots in one end, and a collar is mounted over the one end of the sleeve with a radially extending set screw therein for forcing the slotted end of the sleeve against a shaft extending through the sleeve.

5. A chuck according to claim 1 wherein each segment has a pair of radially spaced guide pins extending from each end surface thereof.

6. A chuck according to claim 1 wherein the arcuate outer surfaces of the segments have longitudinally extending splines.

7. A chuck according to claim 1 wherein there are three cams and a pair of spring rings positioned in a pair of annular grooves defined between the cams.

8. A chuck according to claim 1 wherein the sleeve comprises a solid shaft.

* * * * *